United States Patent [19]

Graf

[11] Patent Number: 4,938,486

[45] Date of Patent: Jul. 3, 1990

[54] WATER DISCUS

[76] Inventor: Josef Graf, 8201 Frasdorf, Sagberg 1, Fed. Rep. of Germany

[21] Appl. No.: 353,292

[22] Filed: May 17, 1989

[30] Foreign Application Priority Data

May 20, 1988 [DE] Fed. Rep. of Germany ... 8806676[U]

[51] Int. Cl.[5] ..... A63B 65/10

[52] U.S. Cl. ..... 273/424

[58] Field of Search ..... 446/46–48; 273/424, 425; D21/86

[56] References Cited

U.S. PATENT DOCUMENTS

| | | | |
|---|---|---|---|
| 2,624,157 | 1/1953 | Weeks et al. | 446/452 |
| 3,544,113 | 12/1970 | Hand | 273/424 |
| 4,335,536 | 6/1982 | Magid et al. | 446/46 |

FOREIGN PATENT DOCUMENTS

| | | | |
|---|---|---|---|
| 181801 | 4/1955 | Austria | 273/424 |
| 86227335 | 2/1987 | Fed. Rep. of Germany . | |

*Primary Examiner*—Mickey Yu

*Attorney, Agent, or Firm*—Jordan and Hamburg

[57] ABSTRACT

A water discus having a round, outwardly bulging plastic body having a hollow interior and a smooth water gliding exterior surface, and mounted on the periphery of the body an impact protection element in the form of a toroid generated by a circle. The hollow body is made up of a bottom section and a cover having a closable aperture. The cover is in clamping engagement with the bottom section. The bottom section has an annular wall laterally enclosing the hollow interior of the body. The height of the wall is less than the diameter of the circle. The bottom section has a floor which supports the wall and has a portion extending laterally beyond the wall. The floor also has an outwardly bulging obverse surface. The aforementioned laterally extending portion, and particularly an annular ridge formed thereon, supports the impact protection element. The minimum distance between an exterior point on the protective element and the obverse surface of the floor is no greater than 3 mm.

4 Claims, 1 Drawing Sheet

WATER DISCUS

The invention relates to a throwable water discus consisting of a round hollow body of synthetic material bulging outwardly and having a smooth water gliding surface, which is surrounded on its edge by a hollow ring-like impact protection element.

Such a water discus is known from the German Utility Model No. 8622733.5.

The object of the invention is to improve this known discus so that it is easier to manufacture and has substantially better gliding or sliding properties on water.

In accordance with the invention this object is solved in that the hollow body is formed of two parts and its cover comprises a closable opening, where the cover resides in clamping engagement with a bottom section of the plastic hollow body comprising an enclosure wall whose height is less than the diameter of the impact protection element, and in that a spacing is provided between the edge of the bottom section and the impact protection element which does not exceed 3 mm.

The essential advantage of the discus according to the invention is that due to the spacing between the plastic hollow body and the impact protection element, the cohesive force of water to the gliding surface is effectively disrupted and this results in advantageous flow conditions, such that the discus can slide substantially further on water than the above mentioned known discus. A divided wall provided on the inner surface of the bottom section also contributes to this, which has the purpose of retarding the water filled into the discus in its relative movement with respect to the discus, which itself rotates when in use. In other words, the filled water has a rotational component when the discus is in use which is substantially the same as the discus.

An embodiment of the invention is discussed in the following in conjunction with the attached drawing.

Figure 1:
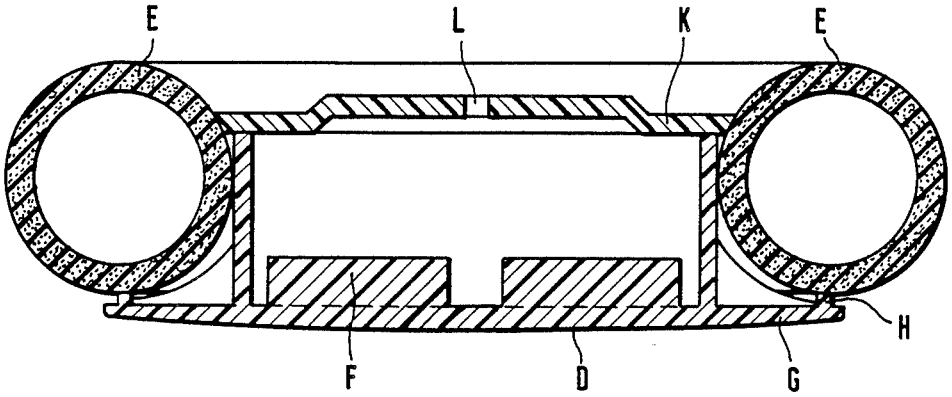
FIG. 1 shows a vertical cross section through the discus.

FIG. 1 shows a throwable water discus consisting of a hollow plastic body comprising a cover K and a bottom section D as well as an impact protection element in the form of a hollow ring E, which surrounds the periphery of the hollow plastic body. A closable opening L is provided in the cover K, through which an appropriate amount of water can be filled into the interior space of the hollow plastic body.

An enclosure wall M which supports the cover K and whose edge is in locking engagement with the edge of the cover, has a height such that the hollow ring E completely surrounds the hollow plastic body in its upper region. Therefore when using the discus, there is no danger of personal injury.

The circular bottom section D is bulged or curved outwardly and comprises an edge section G which extends beyond the enclosure wall M. This edge section G is extended so that it covers a portion of the hollow ring E which corresponds to at least half of the diameter of the hollow ring E. Furthermore, the free end of the edge section G, as shown in FIG. 2, is positioned at a spacing B from the outer side wall of the hollow ring E, where the spacing B is smaller than the ring diameter.

Figure 2:
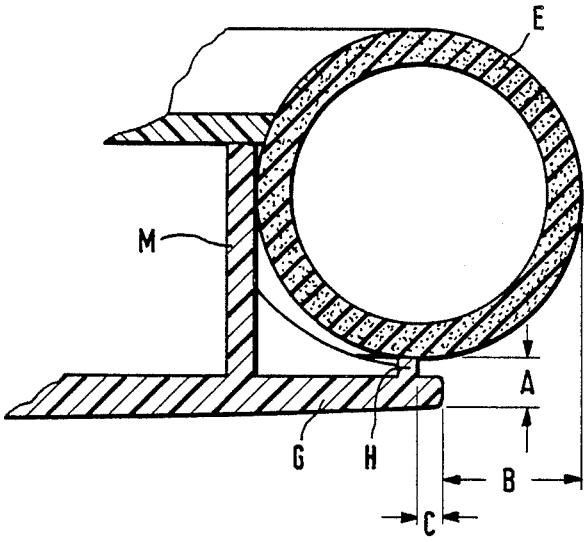
FIG. 2 shows the right hand part of the discus in FIG. 1 in enlarged scale.

A spacing A is provided between the free end of the edge section G and the outer wall of the hollow ring E, as is clearly shown in FIG. 2, where this spacing A is made up of the thickness of the bottom section and the height of a circumferential or annular ridge H. This ridge H projects from the surface of the edge section G facing the hollow ring E and is dimensioned so that when throwing the discus onto water, the cohesion of water between the gliding surface of the bottom section D and the hollow ring E is effectively broken, where this effect contributes to achieving better gliding properties of the discus. The height of the ridge H and the thickness of the bottom section G has been selected in this embodiment so that the spacing A is maximally 5 mm. As already mentioned, the edge section G, which extends beyond the enclosure wall M, is larger than half of the diameter of the hollow ring E. The annular ridge H is located a small distance from the end of the edge section G, where this distance C is maximally 2 mm. Therefore, the ridge is displaced at a position which is substantially below the center point of the hollow ring.

As shown in FIG. 1, a wall F extends along the diameter on the inner floor of the bottom section D. This wall does not extend continuously between the enclosure walls, but a section is left out at its center and the wall section has a length so that it ends at a distance away from the enclosure wall M.

Advantageous modifications of the described embodiment can be made without departing from the core of the invention.

I claim:

1. A water discus comprising a round, outwardly bulging plastic body having a hollow interior and a smooth water gliding exterior surface, and mounted on the periphery of the body an impact protection element having an exterior surface in the form of a toroid generated by a circle, the hollow body being comprised of a bottom section and a cover having a closable aperture, the cover being in clamping engagement with the bottom section, the bottom section having an annular wall laterally enclosing the hollow interior of the body, the height of the wall being less than the diameter of the circle, and the bottom section also having a floor, the floor supporting the wall and having an outwardly bulging obverse surface, the floor having a portion extending laterally beyond the wall thereby to support the impact protection element, the minimum distance between a point on the exterior surface of the protection element and the obverse surface of the floor being no greater than 3 mm.

2. A water discus according to claim 1, in which the laterally extending portion of the floor extends laterally beyond the wall a distance greater than the radius of the circle and on the laterally extending portion is formed an annular ridge on which the protection element rests, the floor having a free peripheral edge and the ridge being spaced from the edge by a distance not exceeding 2 mm.

3. A water discus according to claim 2, in which a line passing from the center of the circle to the floor and perpendicular to the floor approximately intersects the ridge.

4. A water discus according to claim 1, in which on the floor in the hollow interior of the body is formed diametrically across the floor a discontinuous wall, the discontinuous wall having a discontinuity at the center of the floor and being spaced at its ends from the annular wall.

* * * * *